United States Patent [19]

Kochte et al.

[11] Patent Number: 4,573,234

[45] Date of Patent: Mar. 4, 1986

[54] HAND-HELD VACUUM CLEANER

[75] Inventors: Werner W. Kochte, Ravenna; Paul K. Meeker, Kent, both of Ohio

[73] Assignee: The Scott & Fetzer Company, Twinsburg, Ohio

[21] Appl. No.: 575,028

[22] Filed: Jan. 30, 1984

[51] Int. Cl.[4] ..... A47L 5/24

[52] U.S. Cl. ..... 15/323; 15/344; 15/350; 320/2

[58] Field of Search ..... 15/344, 350, 336, 327 C, 15/DIG. 1, 323; 320/2

[56] References Cited

U.S. PATENT DOCUMENTS

| | | | |
|---|---|---|---|
| 1,936,369 | 11/1933 | Riebel et al. | 15/402 |
| 2,626,418 | 1/1953 | Kelly et al. | 15/344 X |
| 3,334,370 | 8/1967 | Boyd | 15/344 X |
| 4,011,624 | 3/1977 | Proett | 15/344 |
| 4,209,875 | 7/1980 | Pugh et al. | 15/344 |
| 4,225,814 | 9/1980 | Gantz et al. | 320/2 |
| 4,421,964 | 12/1983 | Buchtel | 200/157 |

FOREIGN PATENT DOCUMENTS

| | | | |
|---|---|---|---|
| 73561 | 12/1951 | Denmark | 15/327 C |
| 990065 | 4/1965 | United Kingdom | 15/344 |
| 1236053 | 6/1971 | United Kingdom | 15/344 |

*Primary Examiner*—Chris K. Moore

*Attorney, Agent, or Firm*—Pearne, Gordon, Sessions, McCoy, Granger & Tilberry

[57] ABSTRACT

A battery-operated dust cup type, hand-held vacuum cleaner is provided with wall-mounted store-and-charge means that supports the cleaner in upwardly pointed position. The cleaner is also rechargeable independently of the storage bracket, using the same charging means. The flap valve associated with the vacuum nozzle of the cleaner is backwardly slanted from the intake mouth in closed position. The flap valve seals on a lip extending around the inner periphery of the nose end of the dust cup. The intake mouth is provided with a serration or comb forming a re-entrant lip at the bottom side of the mouth. The dust bag is mounted independently of the dust cup but also without use of special brackets forward of the vacuum intake. Latch means for the dust cup is mounted immediately adjacent the power switch, and is mechanically arranged to be "forgiving" of variations in manufacturing tolerance. The latch surfaces are hidden from sight and the latch mechanism is protected from dirt and dust within the dust cup by being isolated therefrom by sealing means. A novel sealing means is provided. The thin-walled plastic body forming the housing for the power components comprises two molded halves each of which has stiffening ribs partially penetrating the other in engaging relation. Pairs of posts extend transversely from the outer side walls of the two housing halves into mating and end-abutting relation with each other, and are fastened together in such relation.

28 Claims, 21 Drawing Figures

FIG. 7
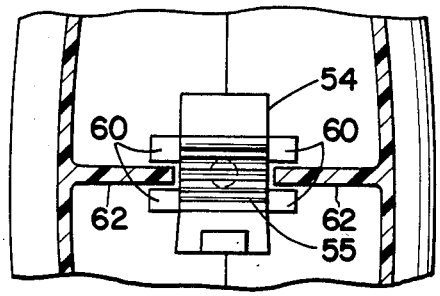
FIG. 8
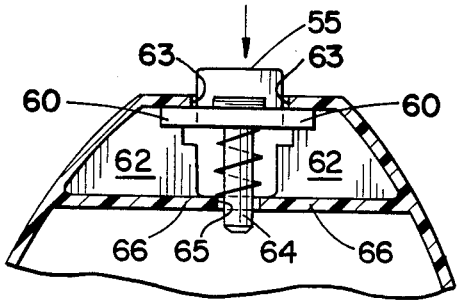
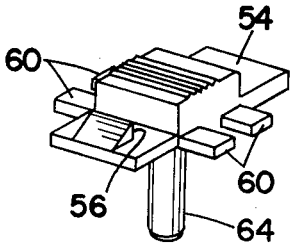
FIG. 9
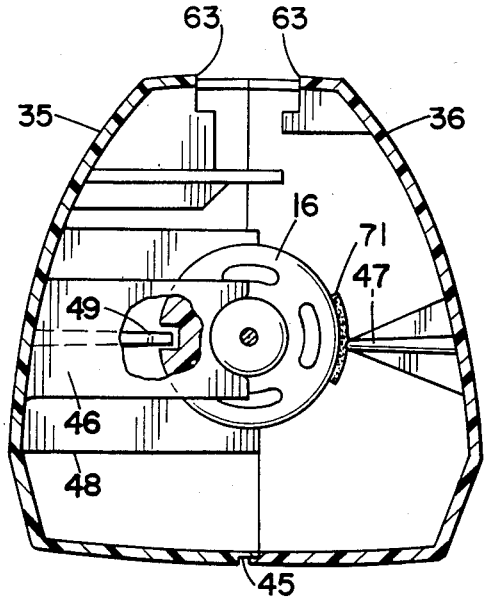
FIG. 6
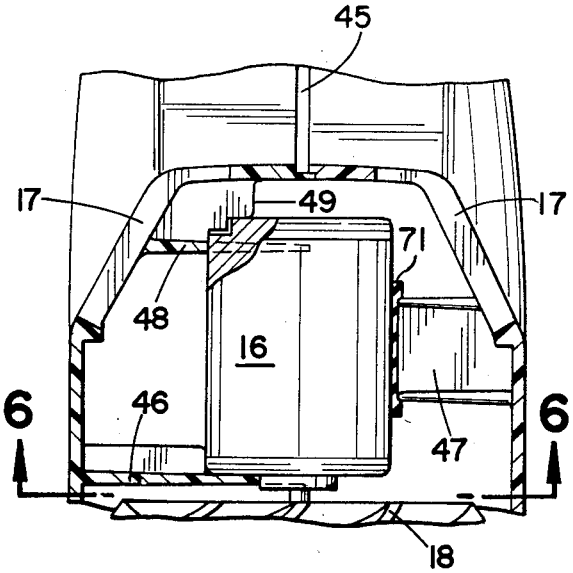
FIG. 5

HAND-HELD VACUUM CLEANER

This invention relates to compact hand-held vacuum cleaners of the type in which a replaceable filter bag is mounted with its closed end extending in the upstream direction of airflow within a tapered hood or dust cup, the vacuum nozzle for the cleaner being at the intake end of the dust cup and the dust cup being detachable from the remainder of the cleaner for emptying from its large downstream end. Such cleaners are also provided with a flap valve associated with the vacuum nozzle to prevent dirt from falling out of the dust cup if power is turned off with the cleaner pointed downwardly—the normal attitude during use. The invention and its several structural features provide a cleaner of such type which is relatively economical to manufacture, effective in operation, and simple and convenient to use, store, and empty.

BACKGROUND OF THE INVENTION

Hand-held vacuum cleaners of the foregoing dust-cup type have previously been provided, and have gained market acceptance, particularly smaller and lighter versions powered by rechargeable batteries carried within the unit. Earlier units had separate nozzle structure outside the upstream end of the dust cup, as in U.S. Pat. No. 3,513,500. Later units had a nozzle integrally formed within the upstream end of the dust cup, as in U.S. Pat. No. 4,209,875.

The advent of practical rechargeable batteries has led to their use as the power source for cleaners of this general type. Since the batteries are exhausted after several minutes of use, it is desirable to maintain them on constant charge during storage of the cleaner. In an effort to accomplish this conveniently, cleaners have been provided with means for automatically connecting and disconnecting the cleaner from a charger as the cleaner is stored or removed from storage for use, as for example in U.S. Pat. No. 4,225,814. However, such store-and-charge means has been rather bulky and ungainly. Also, when wall-mounted for saving of space, such store-and-charge means has required the cleaner to be pointed downwardly, with the vacuum intake end supported on a small ledge. The undesirable result is that any small amounts of dirt trapped upstream of the flap as the cleaner is turned off, on successive uses and storing, tend to successively be deposited on the small ledge or to spill off the edge thereof. Furthermore, the cleaner has not been rechargeable independently of the mounting bracket forming the storage means and to which the charger is permanently connected.

The flap valve associated with the vacuum nozzle of cleaners of the dust-cup type should interfere minimally with airflow while still providing proper shutoff. Prior flap valves in such cleaners have extended substantially perpendicularly to the direction of airflow when in their shut-off position, thereby providing a relatively inefficient, power-consuming arrangement.

The intake mouth itself should be prevented from sealing against the surface being vacuumed by a suitable serration or comb, thereby assuring maintenance of air wattage at all attitudes of the cleaner, and this should be accomplished in a simple manner. Prior art devices of this type have generally failed to provide any such means, evidently because of the perceived difficulty of doing so in a manner that would be aesthetically acceptable and at the same time not unduly costly in respect of increased complications in forming the dust cup as a relatively thin-walled, molded plastic part—the manufacturing method of first choice.

Provision must be made for holding the open mouth of the replaceable filter bag in sealing relationship with the cleaner structure in the vicinity of the large downstream end or mouth of the dust cup when the cleaner is in assembled condition. In one early example of the prior art, seen in U.S. Pat. No. 4,011,624, a bracket was provided extending in front of the impeller intake of the cleaner proper and adapted to be gripped by an elastic bag mouth. In later examples of the prior art, the sealing relationship has been accomplished by providing the dust bag with a flange (as in U.S. Pat. No. 4,209,875) or an elastomeric ring (as in U.S. Pat. No. 3,513,500) designed to engage the mouth of the dust cup and thereby close off and mount the mouth of the dust bag. These relatively complicated arrangements have contributed to the cost and inconvenience of providing and using replacement bags.

Cleaners of this general type are provided with latch means for releasably holding the dust cup in position on the body of the cleaner. Latch means of the prior art have generally been exposed to build-up of dust within the dust cup, leading to a tendency to foul the latch and require it to be cleaned from time to time. Furthermore, the latch means should be easy and convenient to use for ease of cleaning out the dust cup. A power switch is also necessary, an both it and the latch means should be simple and economical to make and to assemble with the remainder of the cleaner. For saving manufacturing costs, it is particularly desirable that the latch be "forgiving" of variations in manufacturing tolerances and yet be easy and reliable in operation over a range of such tolerances.

SUMMARY OF THE INVENTION

The present invention provides a hand-held vacuum cleaner that is relatively economical to manufacture and that overcomes the problems of prior art devices that are catalogued above. The cleaner may be battery-operated and a storage means or a store-and-charge means may be provided which, when wall-mounted, supports the cleaner in upwardly pointed position, avoiding the nozzle fouling and dirt spillage associated with a downwardly pointed nose. The storage or mounting means is relatively compact and light. The upwardly pointed position of the supported cleaner is accomplished by a novel flange and slot arrangement that is easy to use and does not compromise the aesthetics of the cleaner. If desired, the cleaner is rechargeable independently of the mounting bracket that forms the storage means. The flap valve associated with the vacuum nozzle of the cleaner is backwardly slanted from the intake mouth in its closed position. This does not detract from the effectiveness of the flap as a closure, but means that relatively little angular displacement is required under the force of incoming air in order to move the flap to open position. The operative portion of the flap is relatively large, sealing on a lip extending substantially around the inner periphery of the nose end of the dust cup, further contributing to ease of opening. The intake mouth is provided with a serration or comb by forming a re-entrant lip at the bottom side of the mouth. The serrations or teeth of the comb are readily molded as ridges extending from the shoulder formed by the re-entrant lip and thereby have a longitudinal extent greater than the wall thickness of the molded dust cup, thereby giving them a substantial and pleasing appearance.

The dust bag in the cleaner of the present invention is held in sealing relationship with the downstream cleaner structure by means which is independent of the dust cup but which does not require brackets or the like extending forwardly of the intake member (impeller intake) of the cleaner proper, thus reducing the cost and inconvenience of providing and using replacement bags while also avoiding the manufacturing costs that would be associated with providing special cup-independent bracket means forward of the intake. This is done by forming a receiving groove for the bag as part of the structure of the intake mouth and fan cover of the cleaner proper. Such a groove has been found to have no significant effect on vacuum generating action.

Latch means for releasably holding the dust cup on the cleaner body is mountable immediately adjacent the thumbpiece for the power switch for the cleaner, and is loosely constrained for both vertical sliding movement and slight pivotal movement in a manner which enables easy and reliable operation by the user over a range of variations in manufacturing tolerances. The present invention isolates the latch from dusty areas, thereby improving over the prior art in this respect, and also providing a more aesthetically pleasing latch and power switch arrangement than the prior art.

In order to provide a thin-walled, molded plastic body of great comparable rigidity, the present invention provides two molded housing halves each of which has stiffening ribs partially penetrating the other in engaging relation in a manner to be described. Pairs of posts extend transversely from the outer side walls of the two housing halves into mating and end-abutting relation with each other, in which relation they are held by fasteners. This arrangement further contributes to strength and stiffness of the thin-walled housing while limiting the lateral forces imposed at the abutting edges of the walls where the housing halves are joined.

The intake throat of the fan is reinforced by flanges with adjacent contacting side faces on either side of the plane of parting of the housing halves, with mating locating pins and receptacles being provided on the contacting faces for accurate positioning of the critical portions of the structure associated with the fan.

The invention will be more fully understood from the more detailed description below.

BRIEF DESCRIPTION OF THE DRAWINGS

FIG. 5 is a fragmentary, cross-sectional view taken on the plane of line 5—5 in FIG. 2;

FIG. 6 is a cross-sectional view taken on the plane of line 6—6 in FIG. 5;

FIGS. 7 and 8 are fragmentary sectional views illustrating the mounting of the dust cup latch on the cleaner body, with certain parts omitted for clarity;

FIG. 9 is an isometric view of the latch proper;

DESCRIPTION OF THE PREFERRED EMBODIMENT

Figure 1:
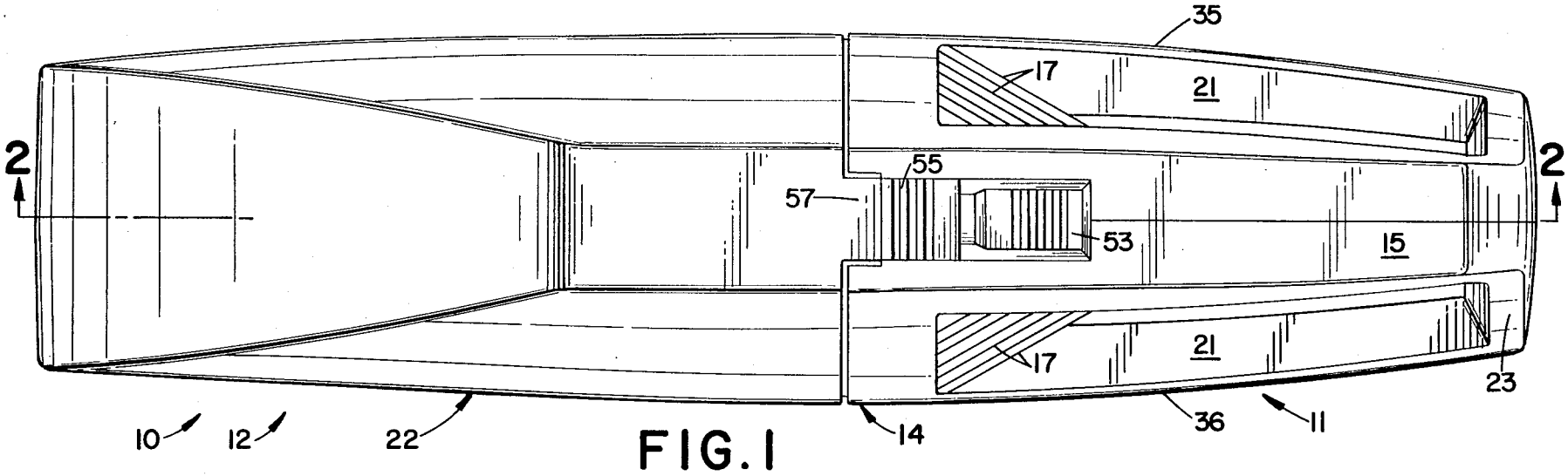
FIG. 1 is a top plan view of a vacuum cleaner illustrating an embodiment of the invention.

In the following description, numbers within parentheses refer to figure numbers of the drawings.

Shown in the drawings is a hand-held vacuum cleaner generally indicated at 10 (1, 2, 19, 20) comprising a first unit generally indicated at 11 and a second unit in front of the first unit and generally indicated at 12. The first unit 11 includes a housing 14 enclosing motor 16 (2, 5, 6), impeller or fan 18 (2, 3, 5, 10), and batteries 20 (2). The housing 14 has a handle portion 15 (2, 4, 19) under which is formed an open finger hole 19.

When the cleaner is assembled, the interior of the first unit 11 constitutes the pressure side and the interior of the second unit 12 constitutes the vacuum side, the two sides being divided by the front portions of the housing 14, such front portions also constituting a housing and intake for the fan 18. The fan 18 and its relation to its own housing and intake are preferably as described in copending application for a vacuum generating system, Ser. No. 06/539,103, filed 10/5/83, of common assignee, and form no part of the invention described and claimed herein.

The second unit 12 includes a hollow dust-receiving cup 22 (1, 2, 19, 20) upstream of the fan and an intake mouth 24 (2, 19, 20) at the front end of the cup. A dust bag 26 (2) is mounted to extend within the dust cup. The open mouth of the bag is presented toward the stationary fan intake throat 28 which is at the front end of the housing 14 and communicates with the interior of the dust cup 22. Support means or hangers, such as the hanger arm 25, may extend from one or more sides of the intake throat 28 to prevent collapse of the bag. A stationary fan housing or cover 30 extends outwardly and rearwardly from the fan intake throat to the remainder of the housing 14. Air passes around the motor 16 and is exhausted through the vent openings 17 (1, 2, 5, 19) formed in the wall of housing 14.

Figure 2:
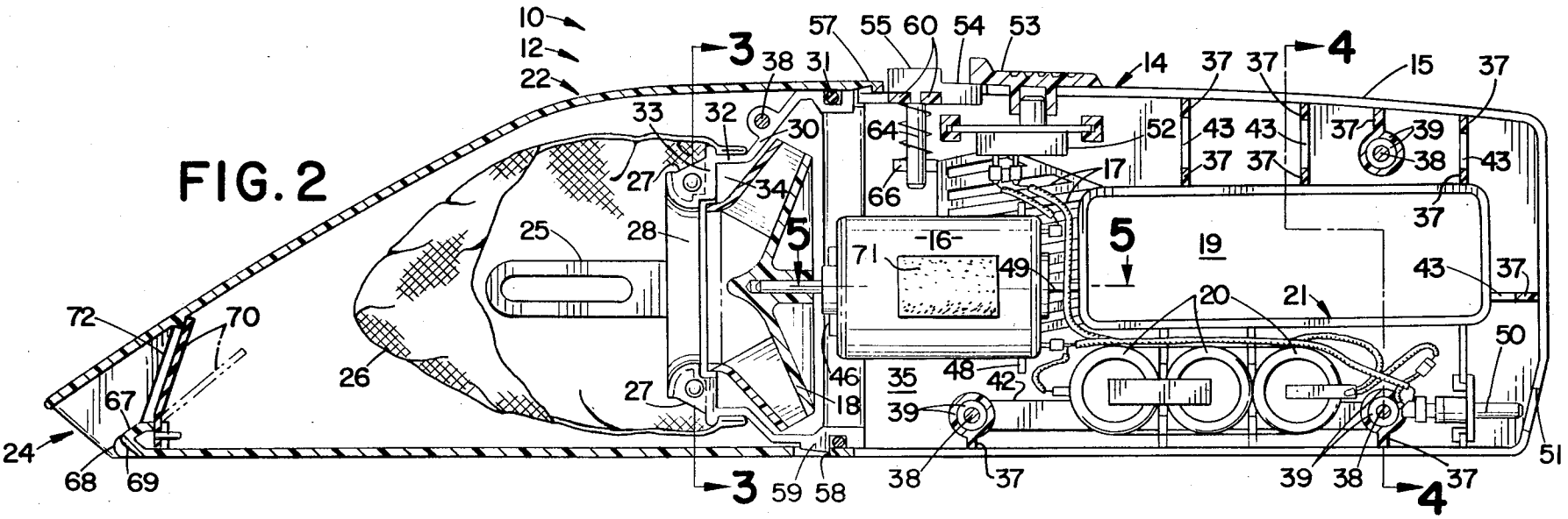
FIG. 2 is a cross-sectional side elevation taken generally on the plane of line 2—2 in FIG. 1 but without sectioning of some of the smaller parts such as batteries, motor, and shaft.

As seen in FIG. 2, a gripping surface for the bag mouth is formed in the stationary fan cover by directing the wall of the housing 14, as it extends forwardly and inwardly, away from its adjacency with the frontward frusto-conical impeller wall or frontward surface of rotation of the impeller 18, as at wall portion 32, and then directing the wall back toward adjacency with such wall 19 or surface of rotation, as at wall portion 33. The mouth of the bag is provided with elastic that grips the wall portion 32. Preferably, a slight radially extending rib is provided between wall portions 32 and 33, as shown, to increase the security of the mounting.

Figure 3:
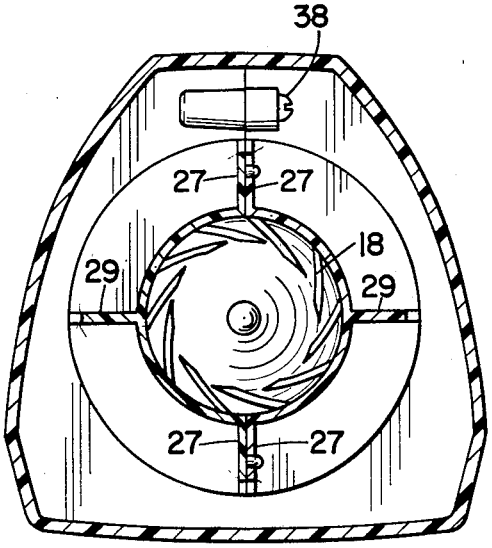
FIG. 3 is a cross-sectional view taken on the plane of line 3—3 in FIG. 2, with certain elements omitted.

It will be seen that the stationary fan intake throat is a forward extension of the wall portion 33. This throat is supported, top and bottom, by flanges 27 (2, 3, 10) on either side of the vertical plane 2—2 of FIG. 1, as well as by similar laterally located flanges 29 (3). The flanges 27 have side faces contacting each other at either side of the central vertical plane. The contacting faces are respectively provided with mating locating pins 31 (2, 3, 10) and corresponding holes or receptacles (not numbered), as best seen in FIG. 3.

The operation of the vacuum system depends on maintenance of an effective slinger-seal action between the wall at the front of the fan rotor or impeller and the stationary fan cover so as to prevent substantial leakage of air from the downstream or pressure side of the fan back around the exterior of the fan to the upstream or vacuum side. While the small plenum 34 formed by the wall portions 32 and 33 might appear to destroy or greatly diminish slinger seal action, it turns out, on the contrary, that the effect on slinger seal action is negligible and that the interaction of the closely positioned rotating and stationary parts on either side of the plenum 34, with each other and with the plenum, are such as to provide substantially as effective an overall slinger seal action as is obtained if the stationary fan cover conforms to the front wall 19 of the impeller throughout their common extent.

Figure 10:
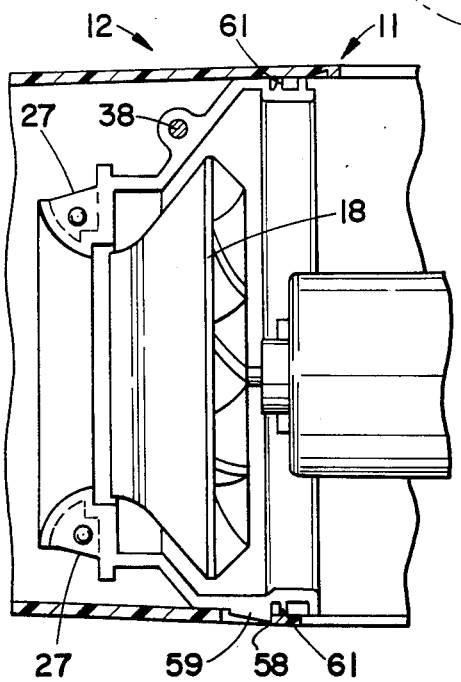
FIG. 10 is a view similar to the central portion of FIG. 2 and showing an alternative form of peripheral sealing means that is preferred according to one aspect of the invention.
Figure 11:
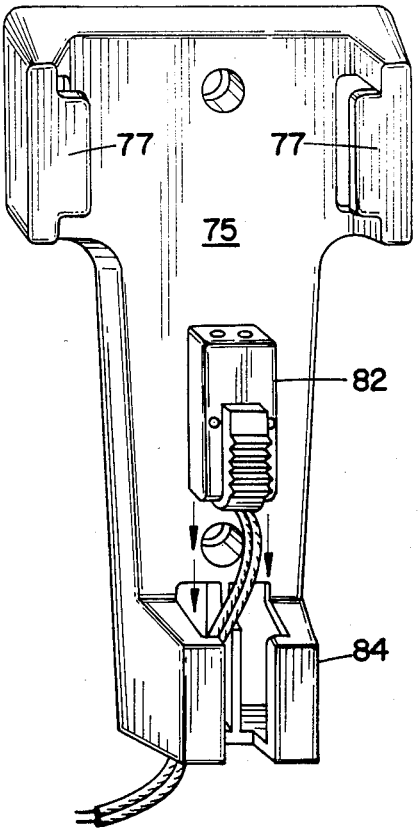
FIG. 11 is an isometric view of a storage bracket for the illustrated cleaner, together with an associated connector plug and power cord.

The housing 14 is formed of two halves 35 (1, 2, 4, 6, 7, 8, 20) and 36 (1, 4, 6, 7, 8, 19, 20) divided generally at the previously mentioned vertical plane 2—2 labelled in FIG. 1. The two halves are fastened together by screws 38 (2, 4, 10, 19) extending from half 36 to corresponding threaded bores in half 35. The upper front screw 38 is covered by the dust cup when the cleaner is assembled, as seen in FIGS. 2 and 10. The heads of the other three screws are each received in a central bore or recess 41 (4) of one of pairs of posts 39 (2, 4) extending transversely from the outer side walls of the housing halves 35 and 36 into mating and end-abutting relation with each other, as shown. The end-abutting engagement of the pairs of posts 39 limits the lateral forces which can be imposed at the abutting edges of the housing walls where the housing halves 35 and 36 are joined. This joining is generally in the region of the vertical plane 2—2 of FIG. 1, where the housing wall edges of each of the housing halves 35 and 36 abut to close off the interior of the first unit 11. According to the present invention, each of the housing halves 35 and 36 has stiffening ribs 37 integrally formed with its walls and projecting beyond the abutting wall edges into supporting contact with the inside of a wall of the other housing half. In some cases, these ribs are also integral portions of bulkhead-like webs 43 (2, 4). Three of the ribs 37 are formed along the three posts 39 that are associated with the housing half 36. The stiffening ribs 37 contribute significantly to the stiffness and strength of the thin-walled structure which forms the housing of the first unit 11.

Figure 4:
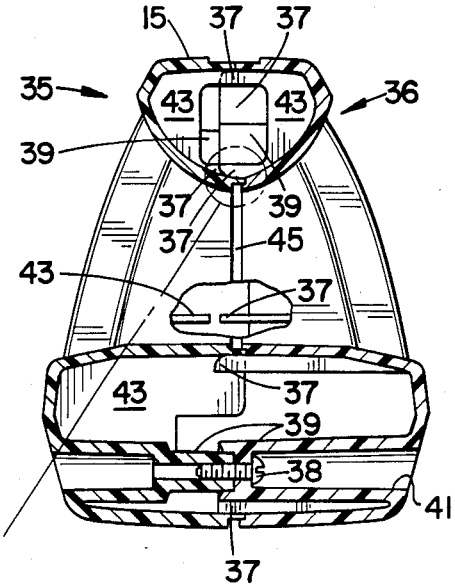
FIG. 4 is a cross-sectional view taken on the planes of line 4—4 in FIG. 2, again with certain elements omitted.
Figure 4A:
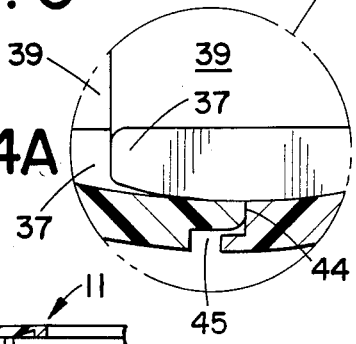
FIG. 4A is an enlargement of a portion of FIG. 4.

The majority of the edge abutment or parting line between housing halves 35 and 36 is visible and is therefore preferably masked by an overlapping gap arrangement as shown in FIG. 4A. If the line of edge abutment along point 44 were directly exposed, the human eye would detect the slightest discrepancies in spacing, so that if dimensions were not perfect, which they never are under economical mass production conditions, unsightly gaps and variations would be perceived. However, the eye cannot detect similar variations in the spacing between sides of a gap, so the (apparently) uniform gap 45 (4–6) has a pleasing appearance to the eye. Where the parting line or line of abutment is to be covered with a decorative tape (not shown) as for example at the top of the first unit 1) as viewed in FIG. 1, no gap 44 need be employed. In FIG. 2, the entire edge of housing half 35 is shown as a simple edge for simplicity of illustration.

The wall of each housing half 35 and 36 is formed with an inwardly extending hollow ridge 42 (2, 14) whose hollow interior is open to the exterior of the cleaner so as to provide grooves or slots 40 (3, 12–14, 19, 20). In the illustrated embodiment, the slots 40 intersect a recess 41 (4, 13, 19) at each slot end, but the screws 38 are recessed far more deeply than the depth of the grooves so that the grooves remain clear. As best seen in phantom in FIG. 12, the grooves 40 become progressively deeper from back to front, since their bottoms 42 taper outwardly more gradually than the sides of the first unit 11 of the cleaner.

In accordance with known manufacturing practice, the first unit of the cleaner may be assembled by laying internal working parts (preferably themselves preassembled) in supported position within one-half of the first unit's housing so that the assembly of the unit is virtually complete except for positioning and fastening of the other housing half, which is then accomplished to "capture" all the parts in their proper positions, thereby greatly simplifying assembly operations. Thus, during assembly, the front bearing for the motor 16 may be positioned in supported relationship on pedestal flange 46 (2, 5, 6) projecting from the wall of housing half 35. Similarly, the rear of motor 16 may be initially supported on pedestal flange 48 and the end notch therein may be keyed to longitudinal flange 49, as best seen in FIG. 6. The motor 16 may then be gripped from the opposite side by pedestal flange 47 (5, 6) when housing half 36 is added, a resilient pad 71 having previously been adhered to the motor. In this manner, accurate alignment of the motor and fan with the stationary fan cover is accomplished in a very simple manner. Proper relative longitudinal spacing is assured by the longitudinal positioning function of the flanges 46 and 49, which together define the longitudinal position of motor 16.

Other elements of the preassembled internal working parts, such as interconnecting leads, may require no special retainers or positioners. Others, such as the batteries 20, may simply be positioned against retaining walls or flanges, as indicated in FIG. 2. Still other elements, such as the male power connector or plug 50 (2, 16) and the power switch body 52 (2), may have flange and groove interconnections with one or both body halves, such interconnections with body half 35 being indicated in FIG. 2. The shank of a thumbpiece 53 (1, 2, 19) fits over the handle stub of switch 52 and is retained for forward and rearward sliding motion by small lateral projections (not shown) at the sides of the shank which are caught under the edges of the walls of the housing halves 35 and 36*a*, which are spaced apart at this location just sufficiently to accommodate the normal width of the thumbpiece shank. These edges are spaced even further apart at locations 63 (6, 8) just forward of the thumbpiece where a latch body 55 (1, 2, 7–9, 19) is mounted, so that the projecting width of the latch body may be accommodated.

The second unit 12 is releasably held in assembled relation with the first unit 11 by latch means which includes the latch body 55. The latch body includes a generally vertical detent shoulder 56 (9) which is unnumbered in FIG. 2 but can be seen in that view to be engageable with a corresponding shoulder on the underside of a rearward extension 57 (1, 2) of the top wall of the dust cup 22. Adjacent the bottom edge of the dust cup is a hole 58 (2) which engages over a button 59 (3, 15) formed in the bottom wall of housing 14.

The latch body 55 includes stubs 60 (2, 7–9) which engage the sides of rib flanges 62 (7, 8). The latch body is loosely but controllably constrained for both vertical sliding movement and slight pivotal movement by an appropriate sliding arrangement such as just described acting together with a vertical guidepost arrangement as illustrated. A guidepost 64 (2, 8–9) forms part of the latch body 55 and loosely pivots in and slides vertically through a stationary bushing hole 65 (8) formed within the housing 14 by the ends of flanges 66 (2, 8). A spring surrounds the post, as illustrated, and urges the latch body 55 toward latched position. With this arrangement, the latch is "forgiving" of variations in manufacturing tolerances and is easy to operate and reliable in operation over a range of such variations. When the latch is depressed, it may be pivoted slightly forward to aid in release. The dust cup 22 is then readily swung slightly around the hinge provided by the hole 58 and button 59 until the extension 57 clears and the cup can be lifted free. To reassemble, the hole 58 is placed over the button 59, and the extension 57 is then snapped in place over the detent shoulder 56.

For pleasing appearance, convenience of operation and simplicity of construction and assembly, the thumbpiece 53 of the power switch means and the latch body 55 are located immediately adjacent each other. The thumbpiece 53 is in sliding overlying position relative to the tailpiece 54 (2, 7, 9) of the latch body when the parts are assembled. The retention of the latch means against lifting movement is in part accomplished by this underlying relationship of the latch means relative to the immediately adjacent thumbpiece.

It is to be noted that the latch structure described above is located rearwardly of the sealing means between the first and second cleaner units 11 and 12. Accordingly, the latch is completely isolated from dirt and dust that is collected in the dust cup 22, and cannot be fouled by the same so as to require cleaning from time to time. Also, the latching edges are completely concealed for pleasing aesthetics. The sealing means between the units 11 and 12 may constitute an O-ring in a groove, as shown in FIG. 2, or preferably a flexible sealing rib 61 as shown in FIG. 10. In either case, the sealing means is provided between respectively the outer and inner peripheries adjacent respectively the front and rear ends of the first and second units. The seal prevents air by-pass or leakage between the units or from the exterior into either unit, thereby preventing the loss of cleaning action which would result from such by-pass or leakage.

In the preferred sealing means shown in FIG. 10, the sealing rib 61 is an upstanding, flexible rib formed around the outer periphery of the first unit 11 adjacent its front end. The rib 61 is integral with and extends from the bottom of the groove in which it is formed and in spaced relation with the two sides thereof. When the first and second cleaner units 11 and 12 are separated, the rib 61 visibly projects past the tops of both sides of the groove in which it is formed. When the cleaner units 11 and 12 are assembled, the rib 61 is slightly deformed and, extending as it does past the tops of both sides of its groove, establishes sealing contact with the inner periphery of the second unit 12. We are aware that previously mold "flash" has been relied on as a seal to prevent air by-pass in small hand-held tools, as for example in U.S. Pat. No. 3,829,721, but the rib 61 of the present invention represents a more accurately formed sealing means which may be precisely dimensioned in width to pre-define its flexing action, and which also may be precisely dimensioned in height to protrude from its integrally formed groove by a pre-defined distance which is uniform around the periphery.

Alternatively, the O-ring 31 shown in FIG. 2 may be employed. The O-ring may be deployed in a single groove, as shown, or it may be deployed in the wider side of a groove (not shown) similar to that of FIG. 10 but with the rib 61 shortened in height and widened to constitute a rigid retainer on one side of the O-ring. In such an arrangement, the modified rib no longer functions as a sealing member, and the O-ring is relied on for that function.

As best seen in FIG. 2, a re-entrant lip 67 extends across the bottom side of the intake mouth 24. The lip 67 is faired to slant upwardly and inwardly to an inner shoulder against which a dust flap 70 is pinned. The dust flap itself slants upwardly and inwardly toward the top side of the dust cup 22. Sealing lip means or ledge means 72 extends from each end of the inner shoulder at least along the inner sides of the dust cup that are adjacent the bottom side. Optionally, the sealing lip means 72 may also extend across the top side of the dust cup, as shown. The sealing lip means 22 receives the flap 70 in sealing relationship in the closed position of the flap. As shown in dotted lines in FIG. 2, the flap 70 slants still further inwardly as it opens during use of the cleaner.

The leading edge of the re-entrant lip 67 is formed across the width of the intake mouth with alternating projections 68 and recesses 69 (2, 20) to provide a serrated edge or comb. This advantageously uses the relatively thin wall of the dust cup to provide an aesthetically pleasing, deep-toothed configuration, and assures that airflow across the extent of the comb remains high when the mouth is in full contact with a surface being cleaned.

Figure 13:
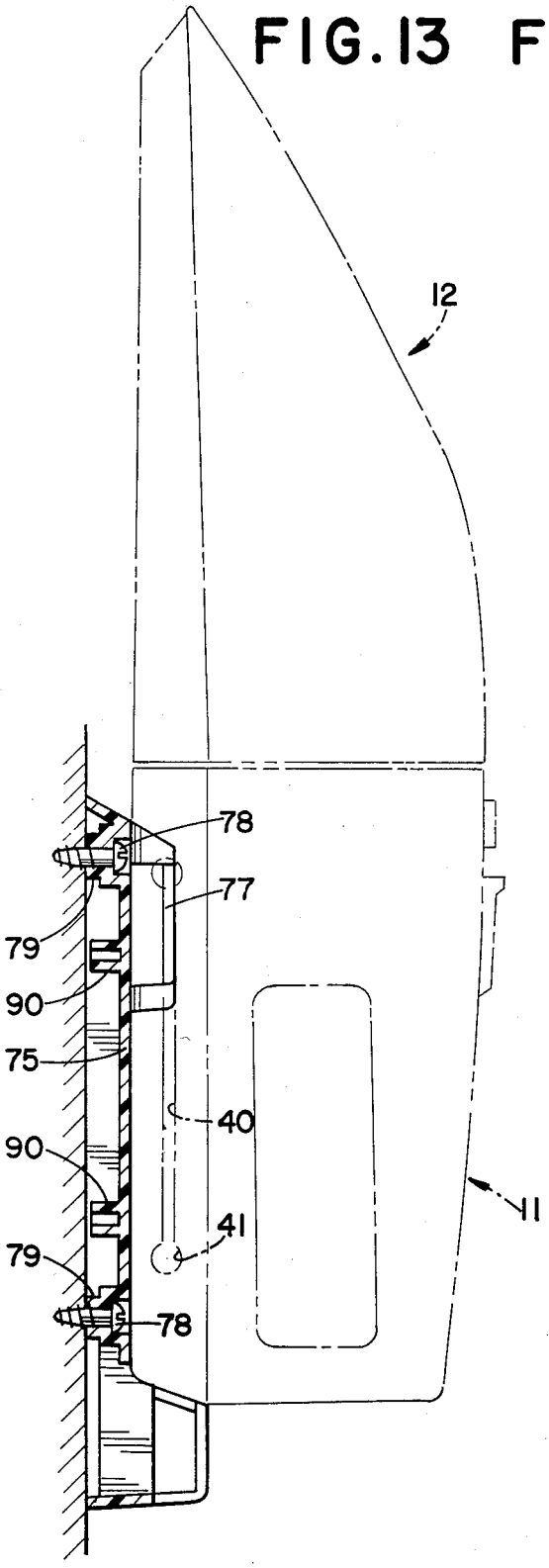
FIGS. 13 and 14 are views taken on the planes of lines 13—13 and 14—14 in FIG. 12 and again showing the cleaner in phantom.
Figure 12:
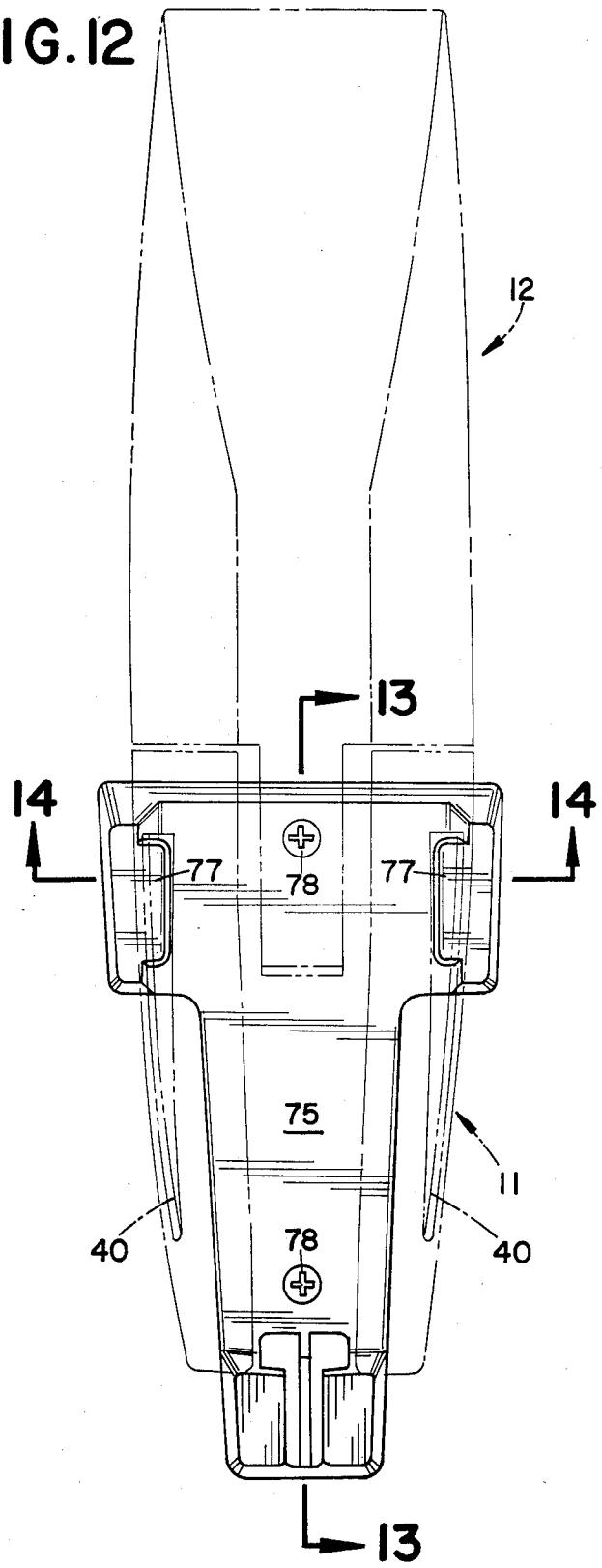
FIG. 12 is a plan view showing the storage bracket of FIG. 11, and with the cleaner shown in phantom in stored position.
Figure 15:
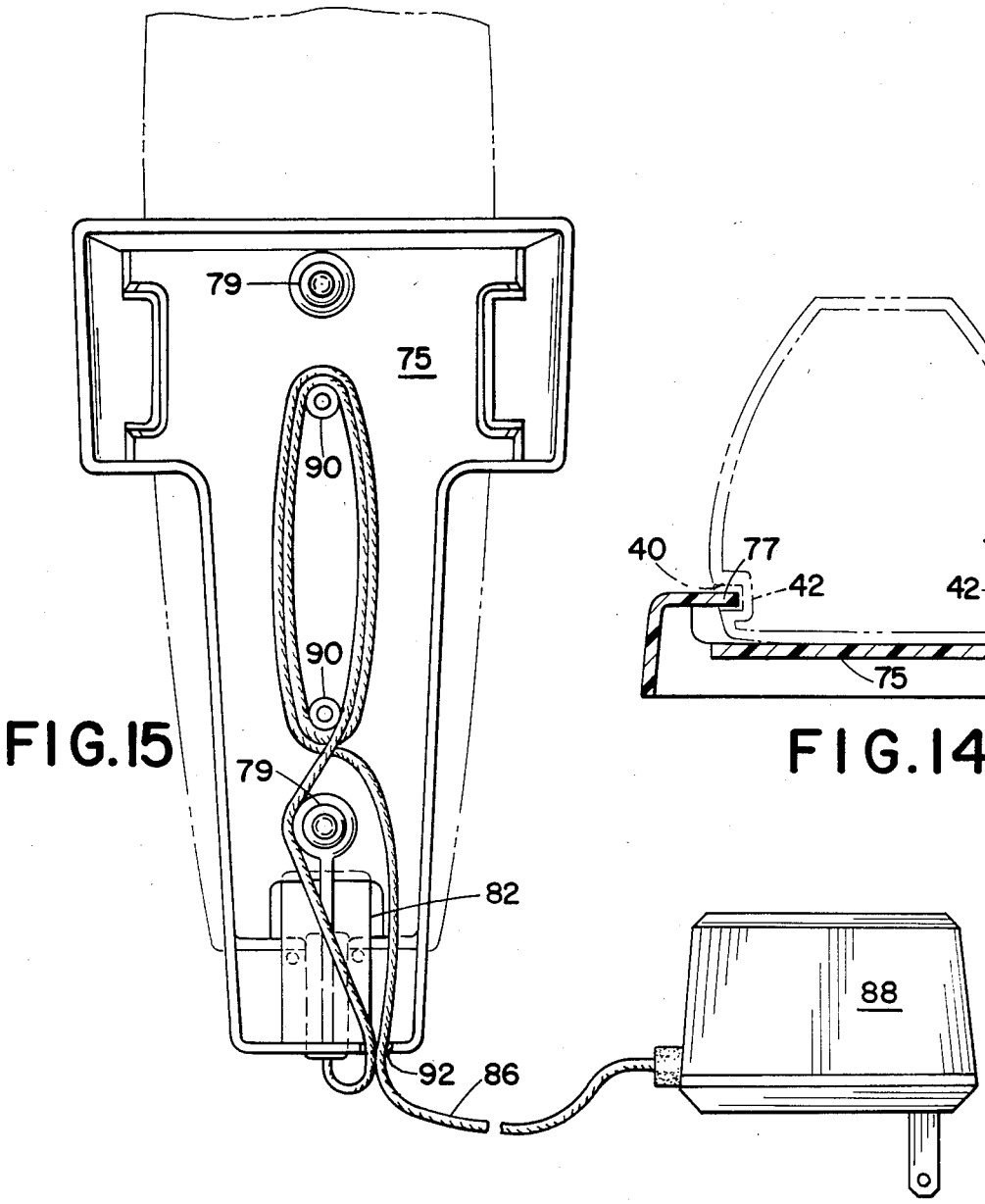
FIG. 15 is a bottom plan view on a slightly enlarged scale, again showing the cleaner in phantom and showing the storage bracket together with an associated connector plug, power cord, and charger to be mounted in an outlet.
Figure 14:
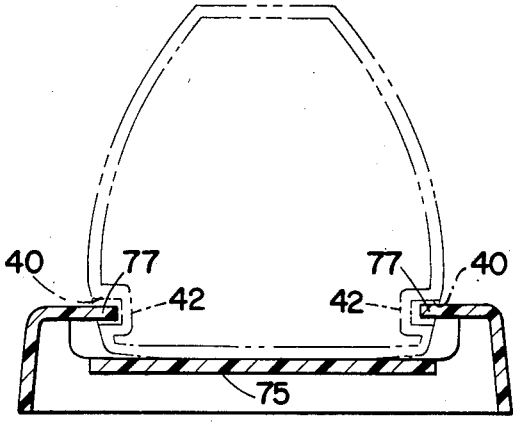
Figure 16:
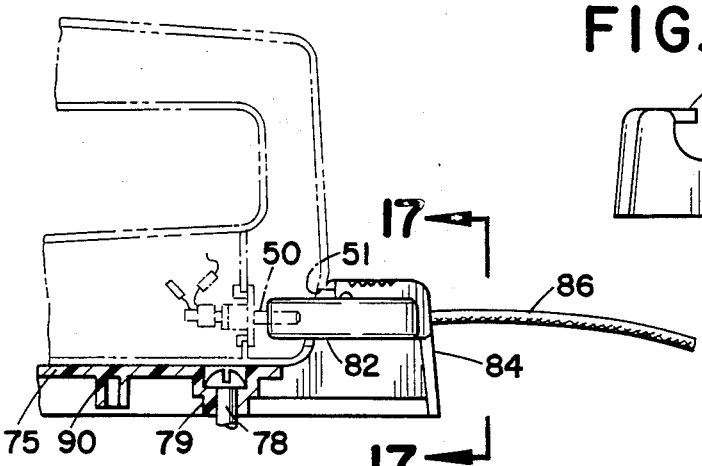
FIG. 16 is a partly broken away, cross-sectional side elevation of the storage bracket, with the connector plug in place, taken on the plane of line 16—16 in FIG. 17 and showing parts of the cleaner in phantom.
Figure 17:
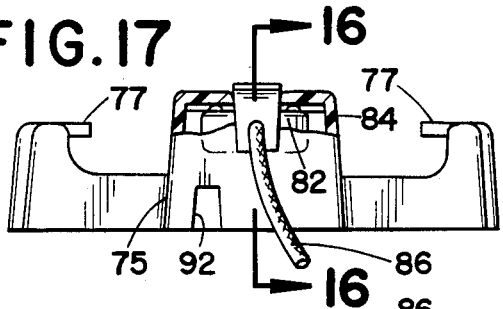
FIG. 17 is a partly broken-away view taken from the plane of line 17—17 in FIG. 16.
Figure 18:
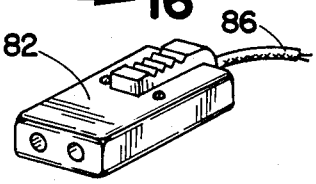
FIG. 18 is an isometric view of the connector plug.
Figure 19:
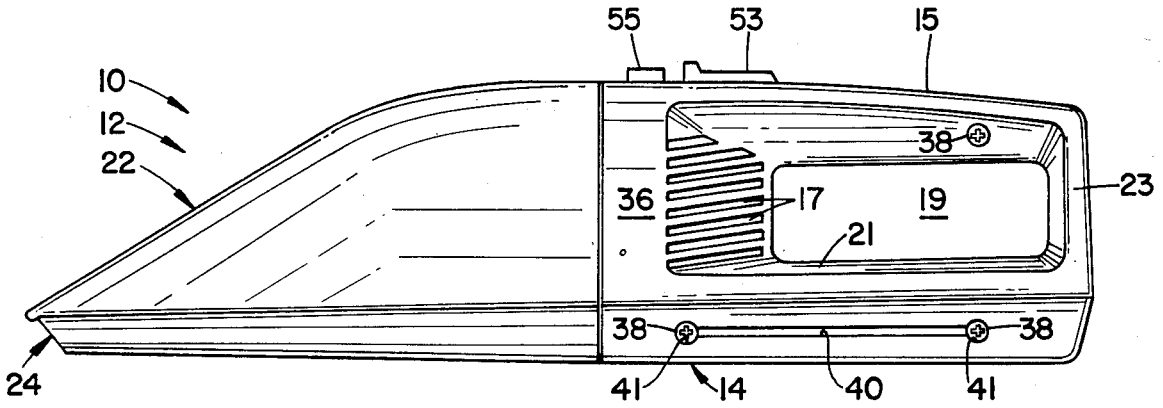
FIG. 19 is an exterior side elevational view of the cleaner on a reduced scale.
Figure 20:
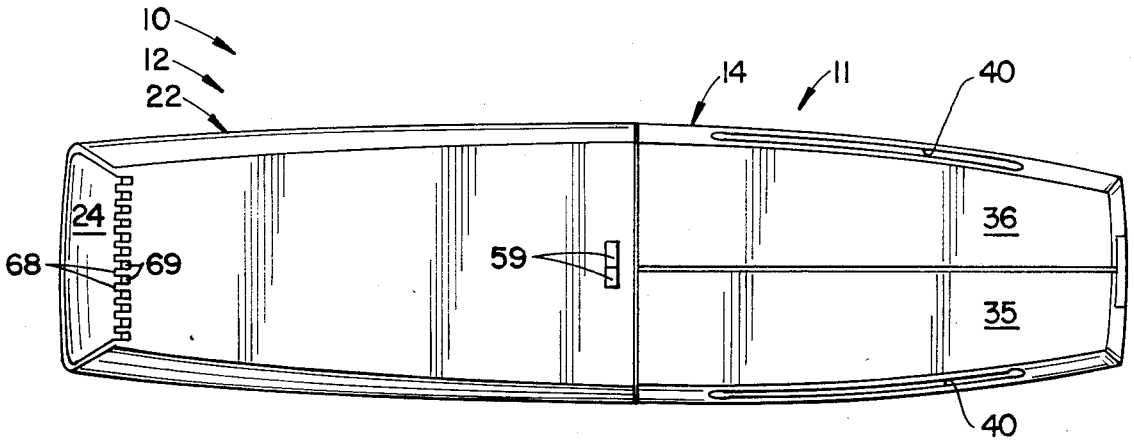
FIG. 20 is a bottom plan view of the cleaner on the same reduced scale.

The cleaner is storable in an upright position, with the intake mouth 24 pointed upward, as best seen in FIGS. 12 and 13. For this purpose, bracket means are provided, including a base 75 (11–17) and a pair of re-entrant flanges 77 (11–14, 17) spaced above the base, that is, outwardly from the base in the vertically mounted position of the bracket means. The base may be fixed to a wall by mounting screws 78 (12, 13, 16) received in suitable countersunk spacers 79 (13, 15, 16). The flanges 77 key into the grooves 40 when the rearwardly tapered length of the first unit 11 is lowered over the bracket.

The male connectors 50 are aligned with an opening 51 (2, 16) in the rear of the housing 14. A removable female connector or plug 82 (11, 15, 18) is removably mountable in fixed position on a tailpiece 84 by means of a flange and groove connection, as shown. The plug 82 is connected via power lead 86 (15, 18) to a wall-mountable plug in charger 88 (15). As the cleaner is lowered over the bracket, the socket formed by elements 50,51 is engaged by the plug 82. When the cleaner is removed from the bracket, disengagement is automatic. When the cleaner is removed, the user can, if desired, lift the plug forwardly (upwardly) to disengage it from the flanges on the tailpiece 84 and remove the plug, lead, and charger for use in recharging the cleaner in places other than where the wall mounting bracket is located.

If desired, a portion of the length of the power lead 86 may be stored within the bracket base 75. For this purpose, wrapping posts 90 (13, 15, 18) are provided to receive the lead and a cutout or port 92 (15, 17) is provided to allow the lead to pass into and out of the base 75. When part of the lead is internally stored in this manner, the plug, lead, and charger cannot be removed from association with the wall mounting bracket until the latter is temporarily disconnected from the wall to which it is fixed.

It is noteworthy that with the cleaner stored in upright position as shown, the intake mouth 24, and particularly the serrated edge or rake formed by the projections 68 and recesses 69, are free and clear of any adjacent supporting ledge or surface where dirt and dust could accumulate.

The finger hole 19 extends from side to side through the housing 14, thereby defining a lower housing portion 21 (1, 2, 19) and a rear portion 23. The top of the lower housing portion 21 is a relatively wide, more or less flat deck. The vent openings 17 open into the finger hole 19 over this deck and venting is thereby proximate to the fan, downstream of the motor, and baffled from the surface being vacuumed.

It should be evident that this disclosure is by way of example and that various changes may be made by adding, modifying or eliminating details without departing from the fair scope of the teaching contained in this disclosure. For example, many of the features of the invention may be in hand-held cleaners that are powered by house current rather than by batteries. The invention is therefore not limited to particular details of this disclosure except to the extent that the following claims are necessarily so limited.

What is claimed is:

1. A battery powered hand-held vacuum cleaner comprising a first unit including a housing enclosing motor, fan and batteries and having power switch means for controlling the motor and vent means for exhausting air, and a second unit partially covering and projecting in front of the first unit and including a hollow dustreceiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a stationary fan intake throat at the front end of said housing and communicating with the interior of the dust cup, a stationary fan cover extending outwardly and rearwardly from the fan intake throat to the remainder of said housing, sealing means between respectively the outer and inner peripheries adjacent respectively the front and rear ends of the first and second units for sealing against air by-pass or leakage between said units or from the exterior to either of said units, said releasable latch means being located in the first unit rearwardly of said sealing means whereby the interengaging and moving parts of said releasable latch means are protected from dust caught within said second unit, storage bracket means mountable on a wall for engaging and storing the cleaner in upright position with said intake mouth pointed upward, said bracket means including a base and a pair of re-entrant flanges spaced outwardly from said base, said first unit tapering rearwardly for a majority of its length but with two grooves formed therein, said flanges keying into said grooves when said rearwardly tapered length of the first unit is lowered over said bracket means, power connector socket means at the rear end of said first unit, upwardly facing plug means mountable in fixed position on the bracket means at the bottom end thereof and adapted to engage in said socket means when the first unit is lowered over the bracket means to be engaged thereby, a wall-mountable charger connected to said plug means by a power line, said plug means being liftable from its mounting when said first unit is raised from said interengagement to allow said plug means, power line and charger to be removed from association with said bracket and used with said cleaner independently of said bracket means, a dust bag hanger extending from one or more sides of the fan intake throat into the interior of the dust cup, a dust bag mounted to extend from the front end of the housing into the interior of the dust cup in covering relationship with the hanger and having an open bag mouth presented toward the fan intake, and means for holding the bag in mounted position, a re-entrant lip extending across said intake mouth at its bottom side, said lip being faired to slant upwardly and inwardly, to an inner shoulder, a valving flap pinned to said inner shoulder and itself slanting upwardly and inwardly toward the top side of the dust cup, the housing of the first unit being formed of two halves divided generally along a vertical plane extending along the length of the housing, said power switch means including a switch body and a sliding thumbpiece, said switch means being retained by interlocking engagement with said two halves of said housing when said halves are assembled together, said thumbpiece being in sliding overlying position relative to said latch means when the parts are assembled, said latch means being retained by interlocking engagement with said two halves of said housing and the underside of the latch means when the parts are assembled, pairs of posts extending transversely from the outer side walls of the two housing halves into mating and end-abutting relationship with each other, fastener means within the mating ends of each said pair to hold them in such relationship, the edges of the walls of said housing halves abutting at the region of said plane to close off the interior of the first unit, each housing half having interior stiffening ribs integrally formed with its walls and projecting beyond its said wall edges into supporting contact with the inside of a wall of the other housing half.

2. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a stationary fan intake throat at the front end of said housing and communicating with the interior of the dust cup, a stationary fan cover extending outwardly and rearwardly from the fan intake throat to the remainder of said housing, sealing means between respectively the outer and inner peripheries adjacent respectively the front and rear ends of the first and second units for sealing against air by-pass or leakage between said units or from the exterior to either of said units, said releasable latch means being located in the first unit rearwardly of said sealing means whereby the interengaging and moving parts of said releasable latch means are protected from dust caught within said second unit, a dust bag hanger extending from one or more sides of the fan intake throat into the interior of the dust cup, a dust bag mounted to extend from the front end of the housing into the interior of the dust cup in covering relationship with the hanger and having an open bag mouth presented toward the fan intake, and means for holding the bag in mounted position, a re-entrant lip extending across said intake mouth at its bottom side, said lip being faired to slant upwardly and inwardly to an inner shoulder, a valving flap pinned to said inner shoulder and itself slanting upwardly and inwardly toward the top side of the dust cup, the housing of the first unit being formed of two halves divided generally along a vertical plane extending along the length of the housing, pairs of posts extending transversely from the outer side walls of the two housing halves into mating and end-abutting relationship with each other, fastener means within the mating ends of each said pair to hold them in such relationship, the edges of the walls of said housing halves abutting at the region of said plane to close off the interior of the first unit, each housing half having interior stiffening ribs integrally formed with its walls and projecting beyond its said wall edges into supporting contact with the inside of a wall of the other housing half.

3. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a stationary fan intake throat at the front end of said housing and communicating with the interior of the dust cup, sealing means between respectively the outer and inner peripheries adjacent respectively the front and rear ends of the first and second units for sealing against air by-pass or leakage between said units or from the exterior to either of said units, said releasable latch means being located in the first unit rearwardly of said sealing means whereby the interengaging and moving parts of said releasable latch means are protected from dust caught within said second unit, a dust bag hanger extending from one or more sides of the fan intake throat into the interior of the dust cup, a dust bag mounted to extend from the front end of the housing into the interior of the dust cup in covering relationship with the hanger and having an open bag mouth presented toward the fan intake, and means for holding the bag in mounted position, the housing of the first unit being formed of two halves divided generally along a vertical plane extending along the length of the housing, pairs of posts extending transversely from the outer side walls of the two housing halves into mating and end-abutting relationship with each other, fastener means within the mating ends of each said pair to hold them in such relationship.

4. A battery powered hand-held vacuum cleaner comprising a first unit including a housing enclosing motor, fan and batteries and having power switch means for controlling the motor and vent means for exhausting air, and a second unit partially covering and projecting in front of the first unit and including a hollow dustreceiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, sealing means between respectively the outer and inner peripheries adjacent respectively the front and rear ends of the first and second units for sealing against air by-pass or leakage between said units or from the exterior to either of said units, said releasable latch means being located in the first unit rearwardly of said sealing means whereby the interengaging and moving parts of said releasable latch means are protected from dust caught within said second unit, storage bracket means mountable on a wall for engaging and storing the cleaner in upright position with said intake mouth pointed upward, power connector socket means at the rear end of said first unit, upwardly facing plug means mountable in fixed position on the bracket means at the bottom end thereof and adapted to engage in said socket means when the first unit is lowered over the bracket means to be engaged thereby, a wall-mountable charger connected to said plug means by a power line, said plug means being liftable from its mounting when said first unit is raised from said interengagement to allow said plug means, power line and charger to be removed from association with said bracket and used with said cleaner independently of said bracket means, the housing of the first unit being formed of two halves divided generally along a vertical plane extending along the length of the housing, said power switch means including a switch body and a sliding thumbpiece, said switch means being retained by interlocking engagement with said two halves of said housing when said halves are assembled together, said thumbpiece being in sliding overlying position relative to said latch means when the parts are assembled.

5. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, the housing of the first unit being formed of two halves, said power switch means including a switch body and a sliding thumbpiece, said switch means being retained by interlocking engagement with said two halves of said housing when said halves are assembled together, said thumbpiece being in sliding overlying position relative to said latch means when the parts are assembled, said latch means being retained by interlocking engagement with said two halves of said housing and the underside of the thumbpiece when the parts are assembled.

6. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, said releasable latch means including a first detent shoulder on the second unit and a detent member having a second generally vertical detent shoulder vertically movable into and out of latching engagement with said first detent shoulder, said detent member forming part of a latch body which is loosely but controllably constrained for both vertical sliding movement and slight pivotal movement by interengaging means associated with the latch body and the first unit's housing, said interengaging means including a vertical post integral with the latch body and loosely pivoting in and sliding vertically through a stationary bushing-hole formed within the first unit's housing, spring means surrounding said post and urging said body toward latched condition, whereby the operation of the latch is "forgiving" of variations in manufacturing tolerances and easy to operate and reliable in operation over a range of such variations.

7. The cleaner of claim 6, the housing of the first unit being formed of two halves, each half defining part of said bushing hole for the vertical post of the interengaging means.

8. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, said releasable latch means including a first detent shoulder on the second unit and a detent member having a second generally vertical detent shoulder vertically movable into and out of latching engagement with said first detent shoulder, said detent member forming part of a latch body which is loosely but controllably constrained for both vertical sliding movement and slight pivotal movement by interengaging means associated with the latch body and the first unit's housing, said interengaging means including a vertical post integral with the latch body and loosely pivoting in and sliding vertically through a stationary bushing-hole formed within the first unit's housing, spring means surrounding said post and urging said body toward latched condition, whereby the operation of the latch is "forgiving" of variations in manufacturing tolerances and easy to operate and reliable in operation over a range of such variations, the housing of the first unit being formed of two halves, said power switch means including a switch body and a sliding thumbpiece, said switch means being retained by interlocking engagement with said two halves of said housing when said halves are assembled together, said thumbpiece being in sliding overlying position relative to said latch means when the parts are assembled, said latch means being retained by interlocking engagement with said two halves of said housing and the underside of the thumbpiece when the parts are assembled, each of said housing halves defining part of said bushing hole for the vertical post of the latch means.

9. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, power switch means mounted within the first unit, a thumbpiece slideplate for actuating said power switch means, said slideplate being slidably mounted on the first unit and slidably contacting the rear of said latch means in retaining relationship therewith.

10. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, a stationary fan intake throat at the front end of said housing and communicating with the interior of the dust cup, a stationary fan cover extending outwardly and rearwardly from the fan intake throat to the remainder of said housing, a dust bag hanger extending from one or more sides of the fan intake throat into the interior of the dust cup, a dust bag mounted to extend from the front end of the housing into the interior of the dust cup in covering relationship with the hanger and having an open bag mouth presented toward the fan intake, and means for holding the bag in mounted position, said means for holding the bag in mounted position comprising an elastic mouth for the bag and a gripping surface for the bag mouth, said gripping surface being formed in the stationary fan cover at an axial location encircling the imaginary surface of rotation of the impeller by directing the housing wall, as it extends forwardly and inwardly, away from adjacency with the imaginary surface of rotation of the impeller, said wall then being directed back toward adjacency with such imaginary surface.

11. A battery-powered hand-held vacuum cleaner comprising a first unit including a housing enclosing motor, fan and batteries and having power switch means for controlling the motor and vent means for exhausting air, and a second unit partially covering and projecting in front of the first unit and including a hollow dustreceiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a stationary fan intake throat at the front end of said housing and communicating with the interior of the dust cup, a dust bag mounted to extend within the dust cup and having an open bag mouth presented toward the fan intake throat, means for holding the bag in mounted position, storage bracket means mountable on a wall for engaging and storing the cleaner in upright position with said intake mouth pointed upward, said bracket means including a base and a pair of reentrant flanges spaced outwardly from said base, said first unit tapering rearwardly for a majority of its length but with two grooves formed therein, said flanges keying into said grooves when said rearwardly tapered length of the first unit is lowered over said bracket means.

12. A battery powered hand-held vacuum cleaner comprising a first unit including a housing enclosing motor, fan and batteries and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, a stationary fan intake throat at the front end of said housing and communicating with the interior of the dust cup, a dust bag mounted to extend within the dust cap and having an open bag mouth presented toward the fan intake throat, means for holding the bag in mounted position, storage bracket means mountable on a wall for engaging and storing the cleaner in upright position with said intake mouth pointed upward, power connector socket means at the rear end of said first unit, upwardly facing plug means mountable in fixed position on the bracket means at the bottom end thereof and adapted to engage in said socket means when the first unit is lowered over the bracket means to be engaged thereby, a wall-mountable charger connected to said plug means by a power line, said plug means being liftable from its mounting when said first unit is raised from said interengagement to allow said plug means, power line and charger to be removed from association with said bracket and used with said cleaner independently of said bracket means.

13. A battery powered hand-held vacuum cleaner comprising a first unit including a housing enclosing motor, fan and batteries and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, storage bracket means mountable on a wall for engaging and storing the cleaner in upright position with said intake mouth pointed upward, said bracket means including a base and a pair of re-entrant flanges spaced outwardly from said base, said first unit tapering rearwardly for a majority of its length but with two grooves formed therein, said flanges keying into said grooves when said rearwardly tapered length of the first unit is lowered over said bracket means, power connector socket means at the rear end of said first unit, upwardly facing plug means mountable in fixed position on the bracket means at the bottom end thereof and adapted to engage in said socket means when the first unit is lowered over the bracket means to be engaged thereby, a wall-mountable charger connected to said plug means by a power line, said plug means being liftable from its mounting when said first unit is raised from said interengagement to allow said plug means, power line and charger to be removed from association with said bracket and used with said cleaner independently of said bracket means.

14. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a re-entrant lip extending across said intake mouth at its bottom side, said lip being faired to slant upwardly and inwardly to an inner shoulder, a valving flap pinned to said inner shoulder and itself slanting upwardly and inwardly toward the top side of the dust cup, the length of the lip from the intake mouth to the inner shoulder being less than the height of the flap from the shoulder toward the top side of the dust cup.

15. The cleaner of claim 14, including a sealing ledge extending from both ends of said inner shoulder around at least part of the remainder of the inner periphery of said dust cup, said sealing ledge receiving the flap in sealing relationship at the closed position thereof.

16. The cleaner of claim 15, the leading edge of said lip being formed across at least a majority of the width of said intake mouth with alternating projections and recesses to provide a serrated edge or comb and assure that airflow across said majority of the width at the mouth remains substantial when the mouth is in full contact with a surface being cleaned.

17. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a re-entrant lip integrally formed with the cup and extending across said intake mouth at its bottom side, said lip being faired to slant upwardly and inwardly, the leading edge of said lip being formed across at least a majority of the width of said intake mouth with alternating projections and recesses to provide a serrated edge or comb and assure that airflow across said majority of the width at the mouth remains substantial when the mouth is in full contact with a surface being cleaned, said projections lying exclusively above a plane defined by a bottom side of the cup.

18. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a valving flap within said intake mouth and hinged along one side thereof, and sealing ledge means extending from both ends of said side at least along the inner sides of the dust cup that are adjacent said one side, said flap in its closed position against said sealing ledge slanting upwardly and inwardly, said sealing ledge means being correspondingly located in said intake mouth, said flap slanting still further inwardly as it opens during use of the cleaner, the hinged side of said flap being attached to the dust cup at a zone spaced from the front end of the cup a distance small in comparison to the slanted width of the flap.

19. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, said housing of said first unit having a handle portion defined above a finger hole extending from side to side through the housing, and a lower housing portion defined below the finger hole, said vent means opening from the interior of the housing to the exterior at the forward side of said finger hole between said upper and lower housing portions whereby venting is proximate to the fan, downstream of the motor, and baffled from the surface being vacuumed.

20. A battery powered hand-held vacuum cleaner comprising a first unit including a housing enclosing motor, fan and batteries and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, storage bracket means mountable on a wall for engaging and storing the cleaner in upright position with said intake mouth pointed upward, power connector socket means at the rear of said first unit, upwardly facing plug means mountable in fixed position on the bracket means at the bottom end thereof and adapted to engage in said socket means when the first unit is lowered over the bracket means to be engaged thereby, a wall-mountable charger connected to said plug means by a power line, said plug means being liftable from its mounting when said first unit is raised from said interengagement to allow said plug means, power line and charger to be removed from association with said bracket and used with said cleaner independently of said bracket means, and power line winding means within said bracket for storing said power line.

21. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, storage bracket means mountable on a wall for directly engaging the first unit and storing the cleaner in upright position with said intake mouth pointed upward, said intake mouth at the front end of the dust cup having a serrated edge at its bottom side whereby airflow remains substantial across the width of the mouth when the mouth is in full contact with a surface being cleaned, said second unit being free of direct contact and adjacency with said bracket means in the stored upright position whereby said mouth and serrated edge are free and clear of association with any adjacent supporting ledge or surface when the cleaner is stored in said upright position.

22. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, said units being connected by releasable latch means, sealing means between respectively the outer and inner peripheries adjacent respectively the front and rear ends of the first and second units for sealing against air by-pass or leakage between said units or from the exterior to either of said units, said sealing means comprising a groove in one of said peripheries, an upstanding flexible rib integral with and extending from the bottom of the groove in spaced relation with the sides thereof and extending upwardly past the top of both sides of the groove into sealing contact with the other of said peripheries.

23. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, sealing means between respectively the outer and inner peripheries adjacent respectively the front and rear ends of the first and second units for sealing against air by-pass or leakage between said units or from the exterior to either of said units, said releasable latch means being located in the first unit rearwardly of said sealing means whereby the interengaging and moving parts of said releasable latch means are protected from dust caught within said second unit.

24. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a stationary fan intake throat at the front end of said housing and communicating with the interior of the dust cap, a stationary fan cover extending outwardly and rearwardly from the fan intake throat to the remainder of said housing, the housing of the first unit being formed of two halves divided generally along a vertical plane extending along the length of the housing, said stationary fan intake throat and stationary fan cover being formed of two halves which themselves are parts of said two halves of the housing of the first unit, separate flange means supporting said stationary intake throat on either side of said vertical plane, said flange means being separated at and having side faces contacting each other at said vertical plane, said contacting side faces having mating locating pins and receptacles formed therein for locking said contacting faces against relative sliding movement in all directions.

25. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, the housing of the first unit being formed of two halves divided generally along a vertical plane extending along the length of the housing, pairs of posts extending transversely from the outer side walls of the two housing halves into mating and end-abutting relationship with each other, fastener means within the mating ends of each said pair to hold them in such relationship, the edges of the walls of said housing halves abutting at the region of said plane to close off the interior of the first unit, each housing half having interior stiffening ribs integrally formed with its walls transverse to said vertical plane and projecting beyond its said wall edges into supporting contact with the inside of a wall of the other housing half.

26. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, the housing of the first unit being formed of two halves divided generally along a vertical plane extending along the length of the housing, the edges of the walls of said housing halves abutting at the region of said plane to close off the interior of the first unit, each housing half having interior stiffening ribs integrally formed with its walls transverse to said vertical plane and projecting beyond its said wall edges into supporting contact with the inside of a wall of the other housing half.

27. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, the spatial relationship and geometry of the elements of the sweeper units being defined in reference to the operational orientation of the sweeper when a front to rear axis of the sweeper is generally horizontal and the intake mouth is arranged to effectively sweep a horizontal surface, said units being connected by releasable latch means, a stationary fan intake throat at the front end of said housing and communicating with the interior of the dust cup, a stationary fan cover extending outwardly and rearwardly from the fan intake throat to the remainder of said housing, the housing of the first unit being formed of two halves divided generally along a vertical plane extending along the length of the housing, said stationary fan intake throat and stationary fan cover being formed of two halves which themselves are parts of said two halves of the housing of the first unit, separate flange means supporting said stationary intake throat on either side of said vertical plane, said flange means being separated at and having side faces contacting each other at said vertical plane, said contacting side faces having mating locating pins and receptacles formed therein for locking said contacting faces against relative sliding movement in all directions, pairs of posts extending transversely from the outer side walls of the two housing halves into mating and end-abutting relationship with each other, fastener means within the mating ends of each said pair to hold them in such relationship, the edges of the walls of said housing halves abutting at the region of said plane to close off the interior of the first unit, each housing half having interior stiffening ribs integrally formed with its walls transverse to said vertical plane and projecting beyond its said wall edges into supporting contact with the inside of a wall of the other housing half.

28. A hand-held vacuum cleaner comprising a first unit including a housing enclosing motor and fan and having power switch means for controlling the motor and vent means for exhausting air, and a second unit partially covering and projecting in front of the first unit and including a hollow dust-receiving cup upstream of the fan, an intake mouth at the front end of the cup, a valving flap within said intake mouth and hinged along one side thereof, and sealing ledge means extending from both ends of said side at least along the inner sides of the dust cup that are adjacent said one side, said units being connected by releasable latch means, storage bracket means mountable on a wall for directly engaging the first unit and storing the cleaner in upright position with said intake mouth pointed upward, the storage bracket means and first unit having surfaces adapted to mutually interengage upon downward vertical movement of the cleaner relative to the bracket means, said mouth being free and clear of association with any adjacent supporting ledge or surface when the cleaner is stored in said upright position.

* * * * *